United States Patent [19]

Dahnert

[11] Patent Number: 4,557,534

[45] Date of Patent: Dec. 10, 1985

[54] MOBILE STORAGE SYSTEMS WITH LEASH CONTROL

[75] Inventor: Dean L. Dahnert, Fort Atkinson, Wis.

[73] Assignee: Spacesaver Corporation, Fort Atkinson, Wis.

[21] Appl. No.: 527,296

[22] Filed: Aug. 29, 1983

[51] Int. Cl.[4] ..... A47B 53/02

[52] U.S. Cl. ..... 312/201; 312/198

[58] Field of Search ..... 312/198–201

[56] References Cited

U.S. PATENT DOCUMENTS

| | | | |
|---|---|---|---|
| 3,961,831 | 6/1976 | Showell et al. | 312/198 |
| 4,017,131 | 4/1977 | Camenisch | 312/198 |
| 4,119,376 | 10/1978 | Moyer | 312/198 |
| 4,441,617 | 4/1984 | Forsberg | 312/198 |

*Primary Examiner*—William E. Lyddane
*Assistant Examiner*—Joseph Falk
*Attorney, Agent, or Firm*—Fuller, House & Hohenfeldt

[57] ABSTRACT

One or more movable storage units each having a reversible motor for driving the units on tracks between stationary storage units to open an aisle between units. Each unit has leash cord plug holders on its aisle sides. The movable units have safety sweep bars on one or both sides, safety switches actuated thereby, and a limit switch. Setting a leash cord plug in its own holder so the leash does not span the aisle that is to be opened provides a move command signal and setting the other leashes so they span the aisles that are too close sets up the control circuitry for causing all units to be driven away from the aisle that is not spanned by a leash. AND gate circuits must simultaneously have input signals indicative of the limit and sweep switches being true, of the leashes being in spanning condition and true for all aisles that are too close and a command signal resulting from having a leash plug in its own holder before the gates will issue a signal that causes the motors to drive in the proper direction. Time delay devices are provided for keeping the sweep switches untrue, at least long enough for an obstructing person to get out of a closing aisle before the drive motors are activated again.

5 Claims, 13 Drawing Figures

AISLE 2
AISLE 1
TIME DELAY
TIME DELAY
RELAY DRIVER
RELAY DRIVER
DC SUPPLY
LEFT SWEEP, LIMIT & LEASH TRUE
MOVE LEFT COMMAND
UNIT 5
UNIT 4
RLS206
LLS36
21M

UNIT 7
AISLE 3
TIME DELAY 114
RELAY DRIVER
RELAY DRIVER
DC SUPPLY
LEFT COMMAND
UNIT 6
AISLE 2

MOBILE STORAGE SYSTEMS WITH LEASH CONTROL

BACKGROUND OF THE INVENTION

This invention pertains to mobile storage systems of the type wherein one or more storage units are movable on tracks to create an access aisle between two of the units and to establish the others in close side-by-side relationship to thereby minimize the amount of floor space required.

Some examples of movable storage units are library bookshelves, file cabinets, film storage files and racks used in warehouses and industry to store parts and finished and unfinished goods. Typically, the storage units are mounted on wheeled carriages which run on tracks. Each carriage has at least one reversible electric motor for propelling it bidirectionally. Usually, at least one outermost storage unit is stationary and the other units are controlled to move toward and away from it to form an aisle somewhere in the group of units.

The present invention achieves several improvements over a prior art system wherein commands by the user for opening an aisle are not initiated in the usual way by pressing pushbuttons but, instead, by causing a leash that normally spans between a closed aisle to become unspanned and thereby provide the move command signal. In typical prior art leash control systems devices called holders are mounted on the front face of each upstanding mobile shelf unit. These holders are essentially electrical sockets. A flexible and self-coiling electric cord or leash is electrically connected to contacts in one socket or holder and another end of the leash has an electric plug attached to it. The plug is otherwise known as a card which is insertable in a holder to make selective electrical connections.

In the prior art systems and in the improved control system described herein, when the user desires to open an aisle between two adjacent mobile shelving units, or between a mobile and a stationary unit, it is necessary for all aisles that are not intended to be accessed to be spanned by the self-coiling and stretchable leash. In other words, the leash attached at one end to a holder on one mobile unit must be placed across any aisle that is not to be accessed and the card at the other end of the leash must be plugged into the holder or socket on the next consecutive unit. The aisle that is to be accessed is chosen by unplugging or removing a card from the holder on the unit on one side of the intended aisle and inserting the card in its own holder on the unit at the other side of the aisle. This results in production of a move command signal which causes the carriage motors to run and drive the mobile units to the left or right as required for opening the aisle. The units are driven until their limit switches are actuated which occurs a moment before the storage units abut each other for completely closing those aisles for which no access is desired.

Systems requiring manipulation of leashes to selectively initiate an aisle opening sequence have been adopted to a large extent for economic reasons. The electric controls and logic circuitry can be more simple and unsophisticated than some of the systems that require user actuation of pushbuttons or switches. The economy and simplicity is, however, achieved in the prior art at the expense of sacrificing some safety features and other desirable functional features as well. For instance, in prior art leash control systems if there is an obstruction such as a small box or part that might drop on the floor between storage units in a formerly open aisle before or during the time that the other units are shifting to open an aisle, the obstructing article can be impacted with the result that the system jams before all of the units can abut each other. At this time there may be very little space between the units for removing the obstruction. This requires driving the units encountering the obstruction away from each other to make the obstructing article accessible in a more widely opened aisle. Thus, prior art electric control systems are usually provided with a key operable switch which must be actuated by the user for coping with an obstruction to override the normal electric control logic and safety devices and set up conditions whereby the aisle containing the obstruction can be opened.

A method previously used to avoid damaging an obstructing object or person in storage unit systems that do not use leashes but use push button or other switches instead, is to equip the storage unit carriages with a sweep bar that sweeps along the floor and actuates a movement arresting safety switch when the bar strikes the object. In prior art systems, when the sweep bar is actuated the carriage is not only inhibited from moving toward the obstruction but the whole system is deactivated and the carriages cannot be moved away from the obstruction until some inconvenient measures are taken. For instance, the user has been compelled to operate a key switch or the like which causes overriding of all of the safety switches so that the mobile unit that has encountered the obstruction can be moved away from it. It is obviously undesirable to inhibit operation of the safety sweep switches.

Safety sweep bars operating drive motor deactivating circuits have been used in control systems where there are pushbutton switch stations on each movable carriage for issuing left and right movement commands to the carriages but, insofar as applicant is aware, no one has successfully used the safety sweep concept in combination with leash control.

SUMMARY OF THE INVENTION

The new control system for movable storage units described herein overcomes the aforementioned and other problems present in prior control systems that use leashes.

An important object achieved with the present invention is to use safety sweep switches in combination with leash control and to provide for maintaining control over all functions of the system exclusively with selective positioning of the leashes. More specifically, in accordance with the invention, the system is activated and a command signal is issued for opening an aisle under normal conditions by simply removing the card or plug at the end of the leash from a holder on a mobile unit on one side of the intended aisle and inserting the card in the holder on the unit on the other side of the aisle while at the same time aisles that are to be closed are spanned by leashes. From that moment, the carriages move in the proper directions in sequence for opening the aisle. However, if an obstruction is encountered between moving storage units or between a moving and a stationary unit in an aisle other than the aisle intended to be opened, the safety sweep switches operate to stop movement of all of the carriages and to prevent further movement toward the obstruction. Now, to obtain the space between carriages for clearing the obstruction, in accordance with the invention, it is only necessary to remove the card from its own holder at the aisle that was intended to be opened and place the card in the holder on the other side of that aisle so that the leash spans the aisle. The next step is simply to go to the aisle that has been prevented from closing by the obstruction where the leash was spanning this aisle when the obstruction occurred and put the card in its own holder. In other words, have this leash in an unspanned state which results in issuing a command to open the obstructed aisle. Now, in accordance with the invention, even though previous actuation of the safety sweep switches prohibited a unit from moving toward the obstruction, only the one that has been activated by the obstruction is overridden or deactivated so that at least one storage unit carriage bounding the obstruction can both move away from it and open the aisle.

It is conceivable that someone might try to open an aisle at a time when a person is in another aisle in which case a mobile unit carriage would run toward the person and only stop when the person is touched by the safety sweep bar which would actuate the safety sweep switches. The tendency for the person under those circumstances would be to step away from the safety sweep bar and attempt to walk to the end of the aisle to get out from between the storage units. In prior systems, removing the pressure from the sweep bar during an effort to move out would make the safety sweep switches true or unactuated again in which case the storage units would start moving until perhaps the foot of the person was touched by the safety sweep bar again. This could be very disconcerting because the aisle width would be decreasing. However, in accordance with the present invention, when a safety sweep is operated, a time delay period such as of about 12 seconds duration is initiated during which the safety switches will not be restored to a true state. This enables the person to walk out of the aisle without having to suffer the consternations of at least one of the mobile units moving toward him or her again.

The manner in which the objects and features mentioned above and other more specific objects and features are achieved will be evident in the more detailed description of a preferred embodiment of the invention which will now be described in reference to the drawings.

DESCRIPTION OF THE DRAWINGS

FIG. 1 is a perspective view of a typical limit switch that is used on the storage units.

DESCRIPTION OF A PREFERRED EMBODIMENT

Figure 1:
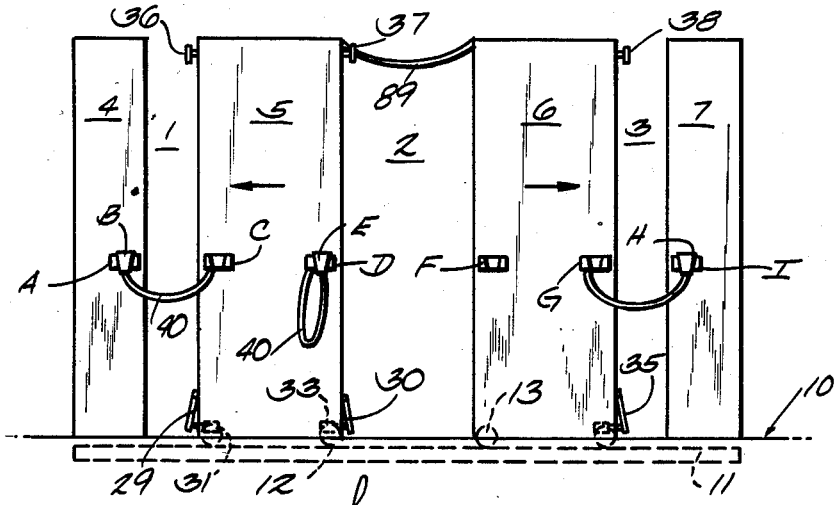
FIG. 1 is a partly diagramatic side elevational view of a movable storage unit system embodying the invention. This figure is used for the purpose of describing what happens in the control circuitry when it is desired to open the center aisle marked 2 in which case at least one unit marked 5 must move to the left and another unit marked 6 must move to the right to open the aisle.

Refer to FIG. 1 for an overview of the mobile storage unit system. The storage unit marked 4, which is seen in front elevation, is stationary. This unit might have storage shelves, not visible, on both sides or it might even be a stationary wall bounding the storage area. There is another stationary unit 7 at the other end of the storage area, and in this particular installation, there are two mobile storage units marked 5 and 6. Stationary units 4 and 7 are fixed to the floor 10. There are parallel tracks 11 set in the floor and the mobile units 5 and 6 have wheels such as those marked 12 and 13 that run on the tracks. The mobile storage units 5 and 6 are actually mounted on carriages, one of which is shown in FIG. 9.

Figure 9:
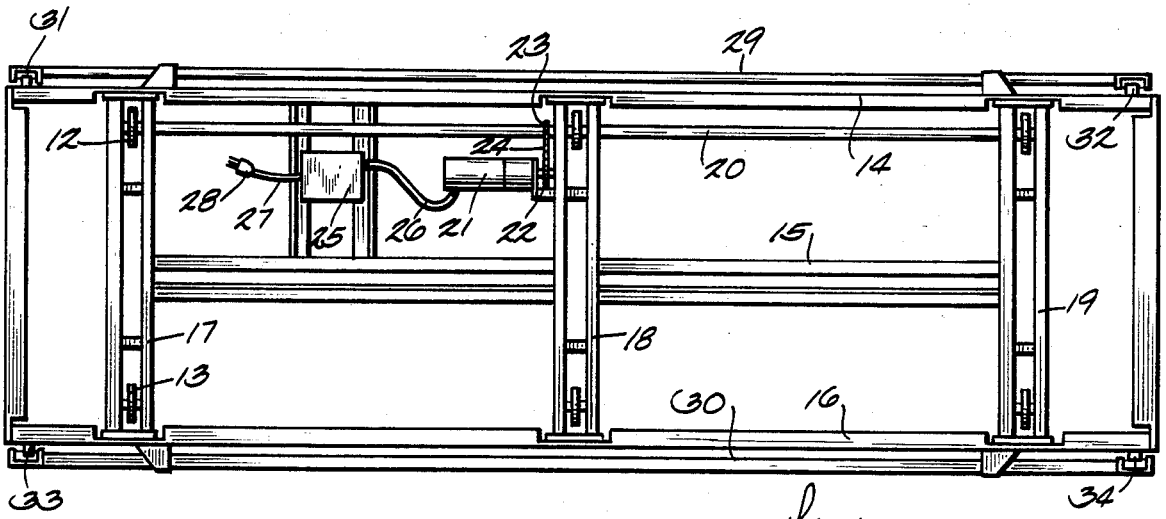
FIG. 9 is a plan view of a typical carriage on which mobile storage units are transported.

As shown in FIG. 9, the carriages are comprised of laterally extending frame members 14, 15 and 16 bridged by longitudinally extending pairs of members 17–19. There is a cross shaft 20 journaled for rotation in longitudinally extending member pairs 17–19. This shaft carries three drive wheels 12. The idler or undriven wheels 13 have their shafts journaled for rotation in the opposite end of longitudinal members 17–19. Each carriage has a drive motor 21. There is a sprocket 22 on the end of the motor shaft and another sprocket 23 on cross shaft 20. A chain 24 couples the sprocket on the shaft of reversible motor 21 to the sprocket on cross shaft 23. A box 25 is provided for housing various control components and logic circuitry. A 3-conductor cable 26 runs from control box 25 to motor 26 for supplying electrical energy to the motor. Every carriage is supplied with electric power from the building main power lines and this is symbolized in FIG. 9 by showing a cord 27 and an attachment plug 28. Low capacity or relatively light weight storage units may be powered by a 115 volt ac source. The particular carriage shown in FIG. 9 is also provided with two safety sweep bars 29 and 30. These bars are pivotally mounted on the carriage frame and actuate a plurality of safety switches, such as those marked 31 and 32 on one side of the carriage and those marked 33 and 34 on the other side of the carriage, when the sweep bars encounter an obstruction. Only unit 5, which is called the master unit, has two sweep bars. The other mobile units such as unit 6 in FIG. 1 are called slave units and have and require only one safety sweep bar 35 as in FIG. 1.

Figure 10:
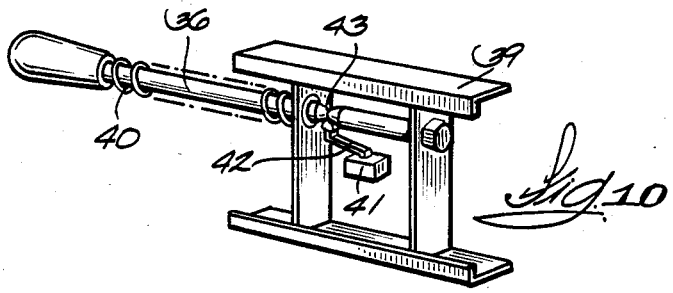

In FIG. 1, the two sweep bars on master unit 5 are marked 29 and 30 and their typical associated safety switches are marked 31 and 33. There are two limit switches on master mobile unit 5 in the FIGS. 1–3 installation. The actuating plunger for one limit switch on master unit 5 is marked 36 and the other is marked 37. In this installation only one limit switch is needed on the single slave unit 6 and its plunger is marked 38. Any mechanical or proximity type limit switches may be used. A suitable limit switch is depicted in FIG. 10. Its actuating plunger is marked 36 and it is mounted for sliding axially on a frame 39 in opposition to a biasing spring 40 which keeps the plunger extended and allows it to yield axially when a mobile unit is coming to its abutting position against another mobile unit or a stationary storage unit. A typical switch is marked 41 in FIG. 10 and its operating arm 42 extends into a reduced diameter groove 43 in plunger 36 such that when the plunger moves axially the arm 42 is actuated and the switch is operated from a closed state to an open state. In the control system described herein, the limit switches are normally true or in a closed state and open a circuit when one storage unit gets close to another, in which case the drive motor for that unit becomes deenergized and the unit stops moving.

In further reference to FIG. 1, the front face or entry end of stationary storage unit 4 has an electrical socket or card holder mounted to it and it is marked with the letter A. At the present time there is a card or plug assembly B nested in holder A. A self-coiling two-conductor leash cord 40 is shown spanning across aisle 1 and connecting to another card holder marked C that is mounted on the front face of master mobile unit 5. The FIG. 1 case is for exemplifying opening center aisle 2. Thus, the card or electric plug E is inserted in its own holder D rather than in holder F so, of course, leash cord 40 is not spanning across aisle 2. When a card E is inserted in its own holder such as D, this produces an electric command signal that results in the mobile storage unit carriages moving in the proper directions, assuming three other preconditions for movement are fulfilled, to establish an open aisle next to the unit wherein the card is inserted in its own holder. In FIG. 1, in contemplation of opening aisle 2, leash cord 40 is spanning across aisle 3 and card H is inserted in holder I. This is called a leash "safe" condition. All aisles that will close rather than open in response to the command signal must be spanned or made safe by leash cords 40 or the command signal will not be effective to initiate mobile unit carriage movement.

It will be understood that although only one slave mobile unit 6 is shown in the 1–3 installation, several additional slave units can also be mounted on the same tracks. Each additional slave unit will be similar to slave unit 6, that is, each will require only one safety sweep such as 35, holders F and G and one limit switch 38.

Figure 5A:
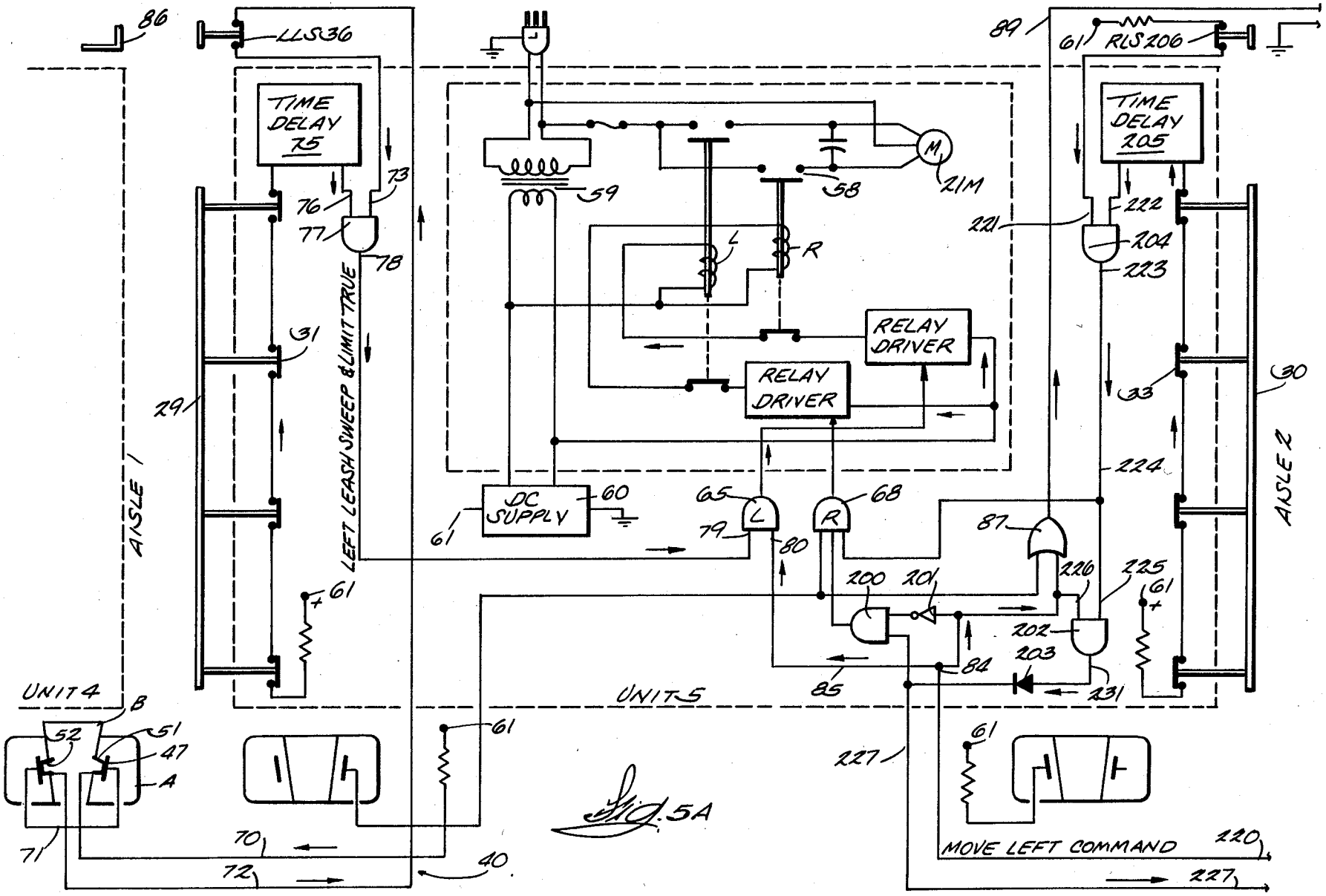
FIG. 5 composed of parts 5A and 5B shows the same control circuitry as the preceding figure except that it is conditioned for opening aisle 3 wherein mobile units shift to the left as in the case of FIG. 2.
Figure 6A:
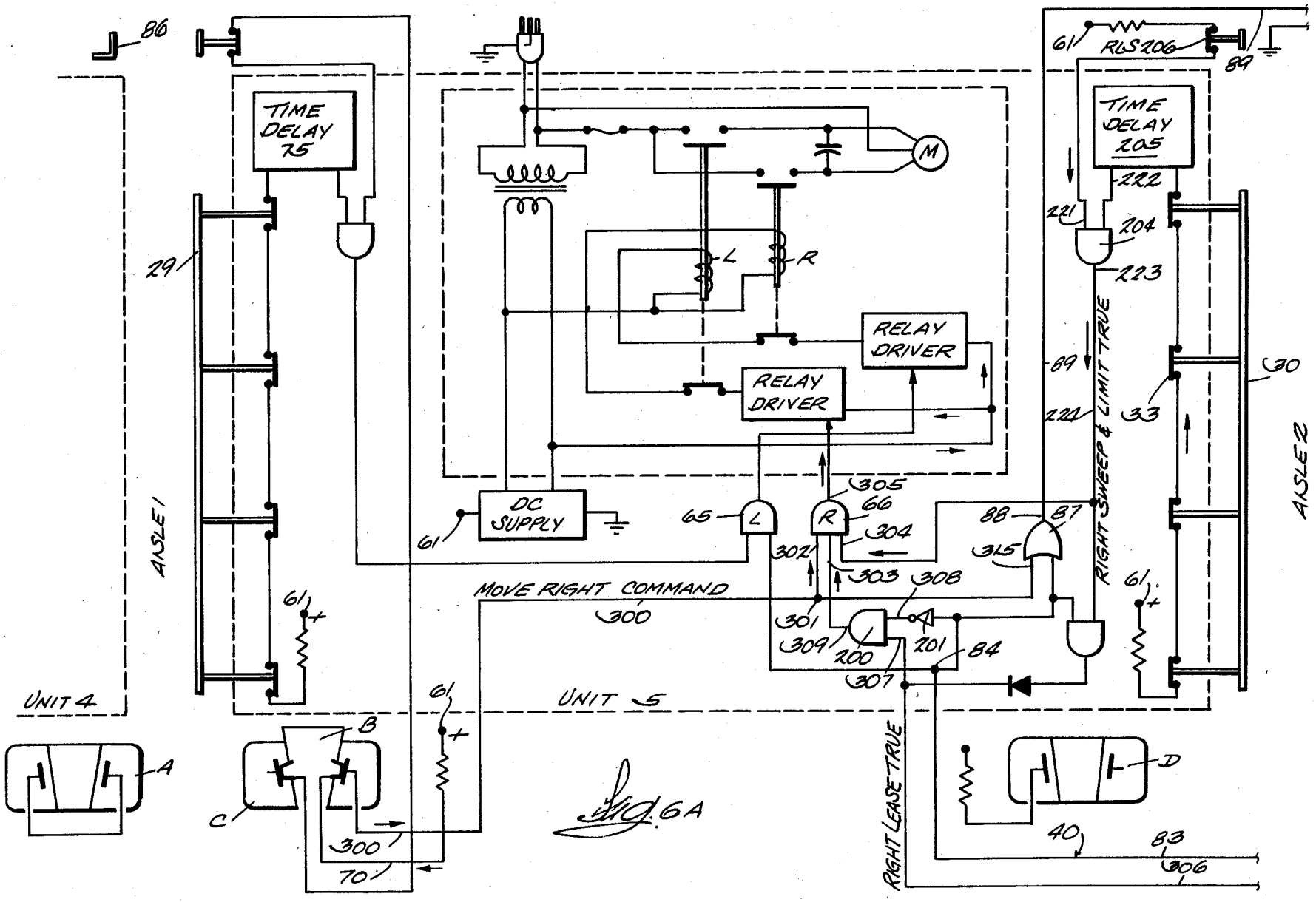
FIG. 6 composed of parts 6A and 6B, is the same diagram as in preceding FIGS. 4 and 5 but conditioned for opening aisle 1 where storage units 5 and 6 both move to the right as in the case of FIG. 3.
Figure 6B:
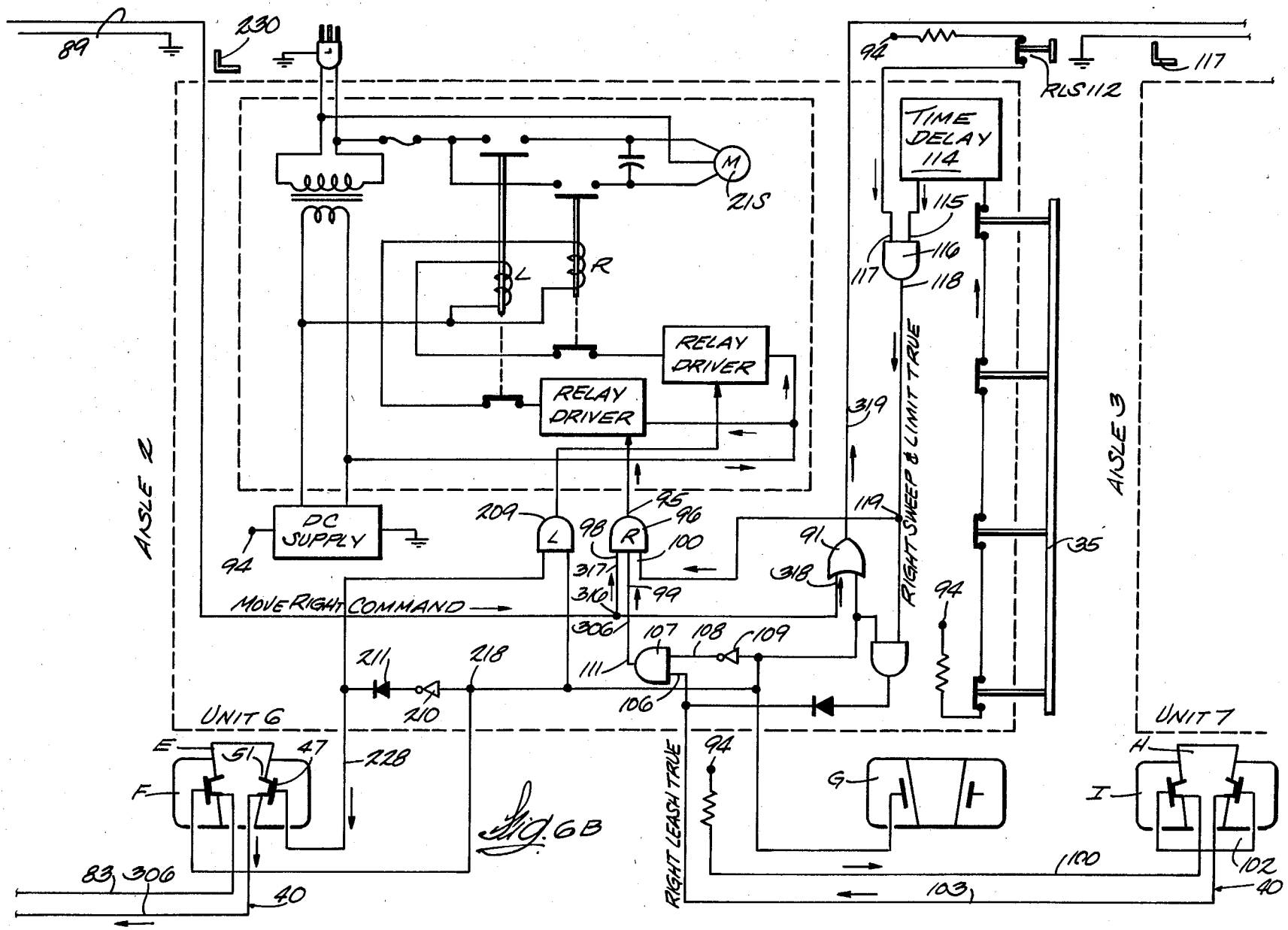
Figure 7:
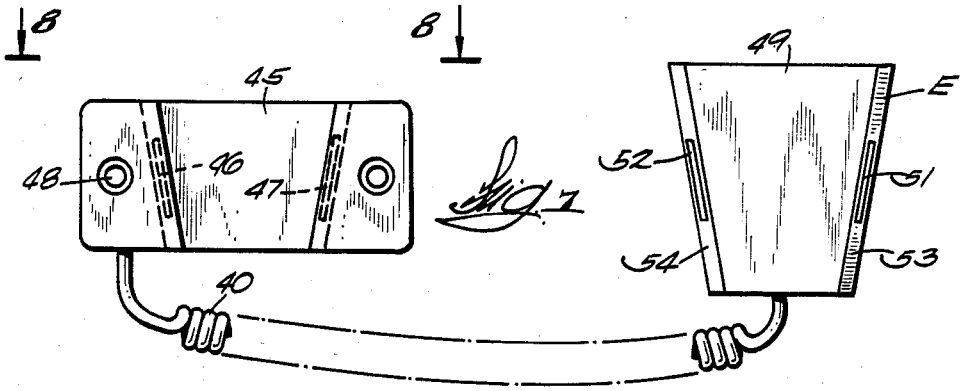
FIG. 7 is a front elevation view of a card or electric plug and a card holder or socket coupled with a self-coiling expansible and contractible electrical cord which together comprise a leash assembly used for controlling movements of the storage unit carriages.
Figure 8:
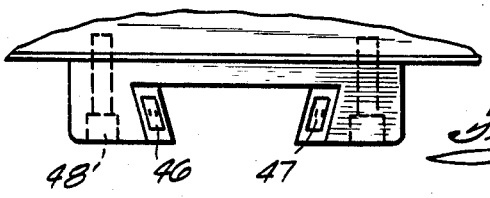
FIG. 8 is a top view of the leash card holder.

A leash assembly is shown in more detail in FIGS. 7 and 8. A card holder typified by the one marked D is a molded body having a v-shaped recess 45. There are fixed contacts 46 and 47 on the side walls of the recess. The electrical connections to these contacts have been omitted in FIG. 7 but will be described in more detail later in reference to FIGS. 4–6. The typical holder D is provided with two counterbored holes 48 for mounting it with bolts on the front face of any of the stationary or mobile storage units.

Opposite sides of the v-shaped recess 45 are slanted toward each other and each one is also slanted toward the rear or back of the holder as is evident in FIG. 8. The leash card or electrical plug in FIG. 7 is typified by card E in FIG. 1 and comprises a body 49 molded of insulating material. The sides 53 and 54 of the card are slanted toward each other and also forwardly so that the card will fit into the v-shaped recess 45 of the holder in only one way. Opposite sides 53 and 54 of the card have electrical contacts 51 and 52, respectively, embedded in them. When the card is inserted in the holder, contact 52 in the card is in conductive relation with contact 46 of the holder, and contact 51 on the card is in conductive relation with contact 47 in the holder. A two-conductor self-coiling leash cord 40 spans between holder D and card E. The electrical connections or terminals of the cord conductors are not shown in FIG. 7 but will be evident later when discussing FIG. 4 and other figures.

The electrical control circuitry for a master mobile unit and for a single slave unit is shown in FIG. 4 which is comprised of parts 4A and 4B. The composite will be used to identify the electrical components in the master storage unit control and in the slave unit control, the latter of which is identical for all slave units. In fact, the master and slave control circuits are quite similar structurally but are caused to function in distinctive ways. FIG. 4 will also be used to explain the operational mode related to FIG. 1 wherein the storage units are being moved in opposite directions to open center aisle 2 which results in closing outside aisles 1 and 3.

In FIG. 4 the master unit, and the slave units as well, are provided with electric power independently from the building power lines as suggested by the attachment plug 28 for the master unit. Power line voltage is input to the primary winding of a step-down transformer 59 whose secondary is input to a regulated power supply 60 that provides a dc control voltage on its output terminal 61 to all the logic elements in the master control. In an actual embodiment, the control voltage is 20 volts, by way of example, and not limitation. The power lines 55 that supply the primary winding of transformer 59 also supply the master carriage unit drive motor 21M. This is a reversing capacitive type motor and the capacitor 56 is shown connected between the input lines to the motor. One input line has a contact 57 in series with it. The other input line has a contact 58 in series with it. When contact 57 closes, the motor runs in a direction that drives the master storage unit 5 carriage to the left in reference to FIG. 1 and when contact 58 closes, the motor runs in a direction to drive the master unit 5 to the right. The relay coil that must be energized to close contact 57 is identified by the letter L. One end of relay coil L is connected to a common wire that connects to one side of the secondary winding of transformer 59. The other side of relay coil L connects through one of a pair of contacts 62L to a relay driver circuit 63. One end of the other relay coil R which is energized for right carriage movement connects to the common line and the other end of the coil R connects through one of the contacts 62R to the output of another relay driver 64. As indicated by the dash lines, contacts 62 and 65 are interlocked with relay plungers so that when one is closed by power supplied from a relay driver, the other is opened. The relay drivers are signaled to drive by output signals from one or the other of a pair of left and right movement control AND gates 65 and 66, respectively. When the output 67 of AND gate 65 switches to a true or high level logical state, relay driver 63 energizes relay coil L which causes motor 21M to run in a direction for driving the master unit 5 to the left. When the output 68 from AND gate 66 becomes true, relay driver 64 would energize relay coil R to cause the motor to drive the carriage to the right.

Four conditions must be fulfilled before the storage unit carriages will start to move for opening a selected aisle between mobile storage units and between mobile and stationary storage units. One condition is that the safety sweep switches must be in a true state or closed on the side of the unit toward which the unit must move. Another condition is that a limit switch on the side of the unit in the direction in which it will move must be closed or in a true state. Another condition is that all of the leash cards, particularly the leash cords, must be spanned across all aisles that will undergo closing to obtain opening of another aisle. And, as a final condition, there must be a command signal provided that determines the direction in which the units will move. This command signal is produced by the user activity of placing a card on a leash that was formerly spanning across an aisle to a holder on one side of the desired open aisle into its own holder on the other side of the aisle. When the command or activation signal is developed in this way, the units will move in the proper direction provided the other three conditions are fulfilled at the same time.

Figure 4A:
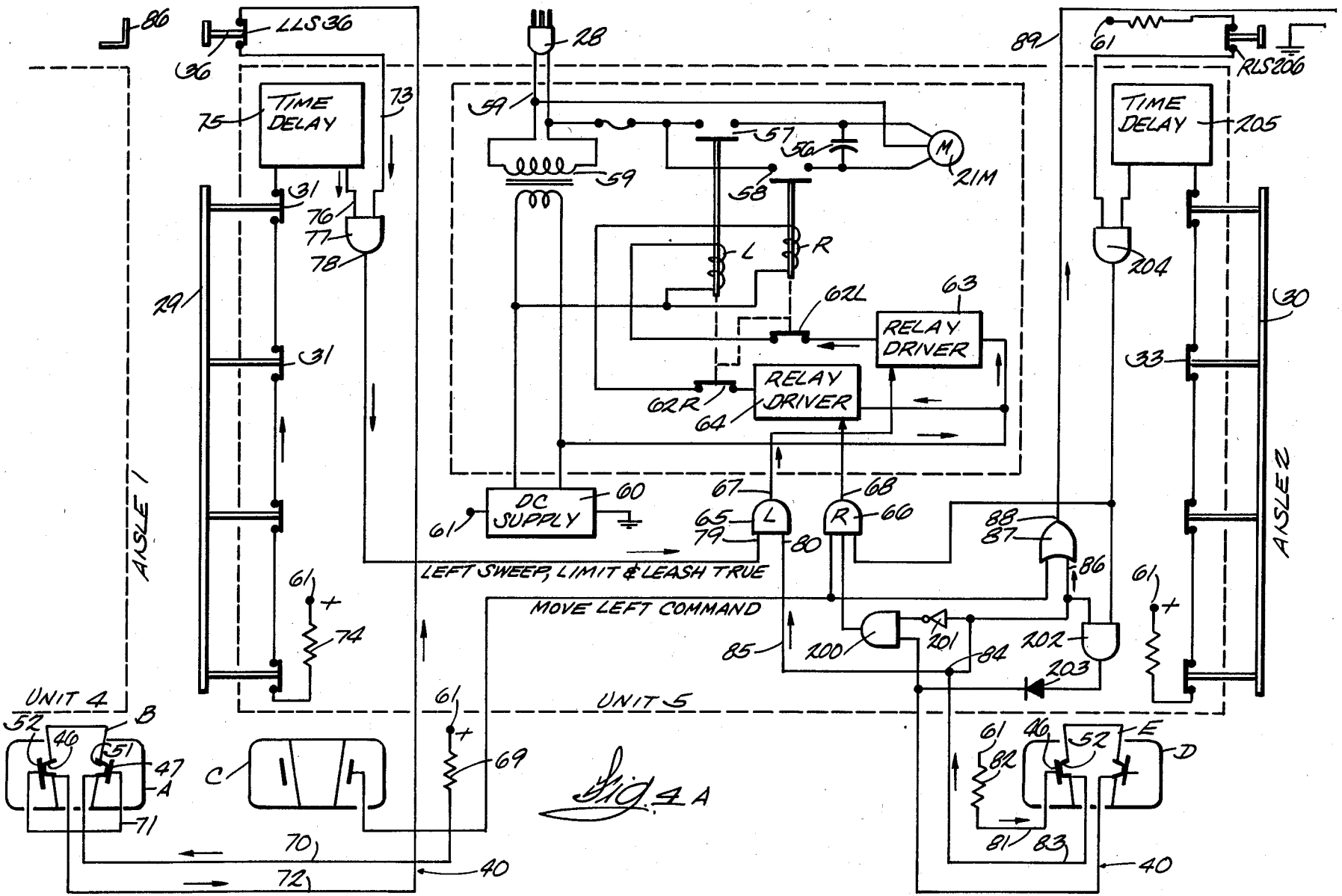
FIG. 4 composed of parts 4A and 4B is a diagram of the control circuitry conditioned for opening center aisle 2 where at least one mobile unit must move to the left and another to the right as in the FIG. 1 case.
Figure 4B:
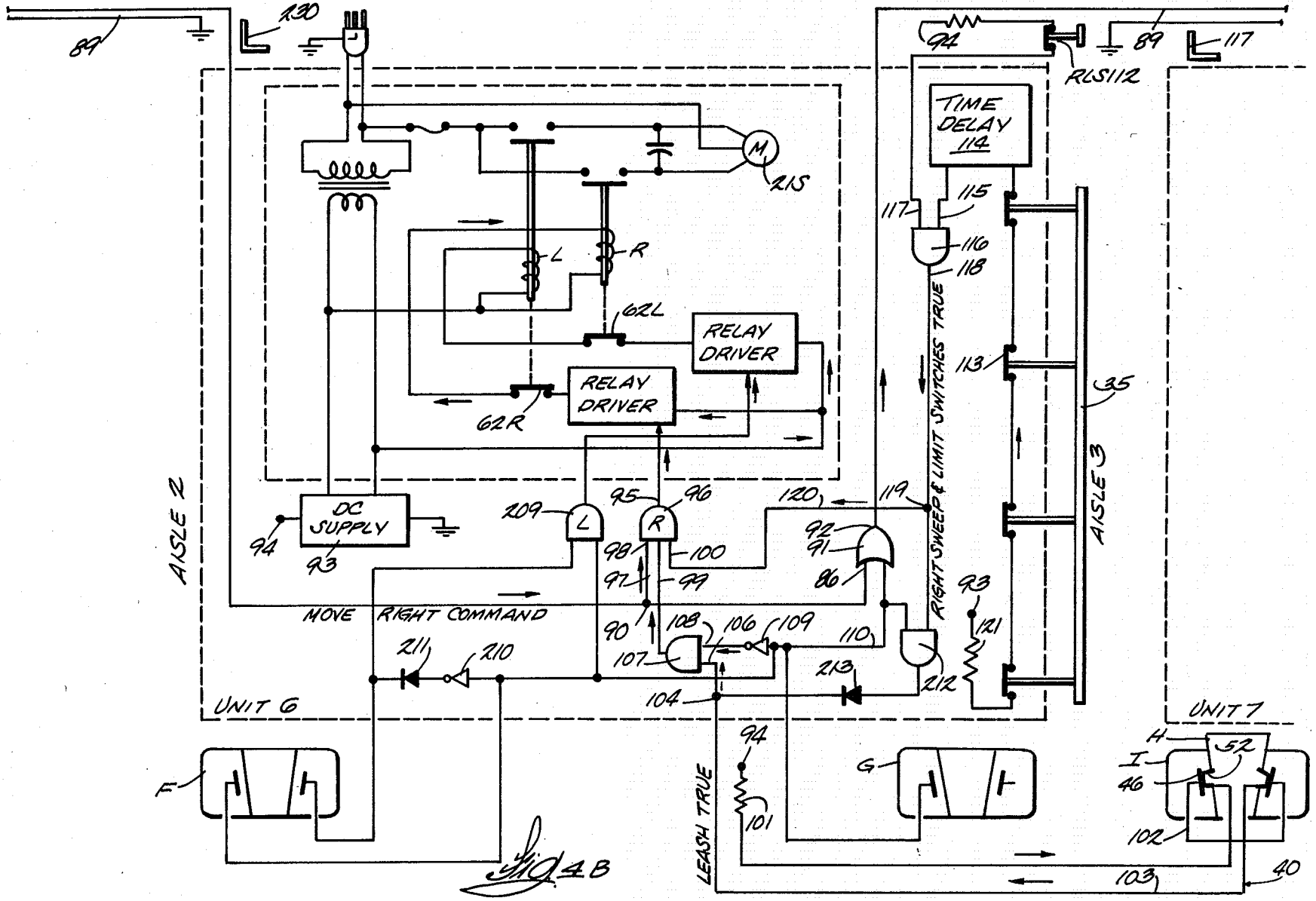

The leashes associated with the mobile master unit 5 are positioned in FIG. 4A correspondingly with their positions in FIG. 1 to set up the conditions for causing unit 5 to move to the left and slave storage unit 6 to move to the right to close aisles 1 and 3 in FIG. 1, respectively, and to open center aisle 2. Thus, leash card B is inserted in holder A on stationary unit 4 so that leash cord 40 spans aisle 1. Similarly, card H which can optionally be inserted in the holder on slave unit 6, or holder I on stationary storage unit 7 is inserted in holder I on the stationary unit so that leash cord 40 extends across aisle 3 which is going to close when a command signal is provided. As previously indicated, and as is true in the case of the operating mode relating to FIG. 1, the command signal is developed in response to the user unspanning the aisle that is intended to be opened and to insert the card in its own holder. Thus, in FIGS. 4 and 1 card E has been removed from holder F on slave unit 6 and inserted in its own holder, that is, in holder D on one side of the aisle that is intended to be opened. In the FIG. 4 circuit diagram and in FIGS. 5 and 6, active signals are indicated by arrows next to their conductors.

To open aisle 2, storage unit 5 must be moved to the left and, as indicated, aisle 1 has to be spanned by the leash. In the lower left of FIG. 4A, and in FIG. 1 card B is inserted in holder A and leash cord 40 is spanning across aisle 1 which is to be closed. There is a control voltage supplied from power supply terminal 61 to a circuit including a pull-up resistor 69 and a line 70 which leads to contact 51 in card B. A circuit is then completed from contact 51 to holder contact 47 and then through a jumper 71, holder contact 46, card contact 52 and out through one of the leash conductors 72. A current must be supplied to line 72 to determine if the left limit switch LLS36 and the left safety sweep switches 31 are all true or closed which are two of the four conditions that must be fulfilled before left movement is permissible. The third condition is that leash 40 be spanned across aisle 1 or the aisle to the left of master unit 5 which is to be closed. Thus, the current source line 72 is in series with the contact of left limit switch LLS36, and, since the limit switch plunger 36 is not actuated, the current or voltage is provided through line 73 to one input of an AND gate 77. Thus, one condition for left storage movement is met. The series connected safety sweep switches 31 which are actuated by safety sweep bar 29 are closed or true since the left safety bar at the moment at least, is not actuated by any obstructing object in aisle 1. The series connected safety sweep switches 31 will have current flowing through them in the direction of arrows adjacent their connecting lines by virtue of the fact that this circuit is fed from dc source terminal 61 through a pull-up resistor 74. The series safety switch circuit terminates in a time delay circuit that is symbolized by the block marked 75. If the safety sweep bar 29 has not been actuated by an obstruction for a predetermined length of time such as 12 seconds in this embodiment, the voltage signal applied to the input of time delay will yield a corresponding signal at the second input 76 of AND gate 77. When this condition prevails, the output 78 of AND gate 77 will switch to its high logical level or true state. The true state is indicative of three conditions being met, namely, that the left leash having conductor 70 and 72 is spanning across an isle that should close, the left safety sweep switches are 31 true or closed, and left limit switch LLS36 is closed or true. The signal representing this composite three bits of information is applied from AND gate 77 output 78 to one input 79 of a left-movement control AND gate 65 which when its output 67 goes to a high logical level or true state signals relay driver 63 to cause unit 5 to drive to the left.

With the three conditions just discussed fulfilled, there will still be no left movement of master unit 5 until a move left command signal is provided to input 80 of AND gate 65 in part A of FIG. 4. As indicated previously, this is accomplished by inserting the card E in its own holder D which is the holder adjacent the aisle 2 that is to be opened. Directing attention to card E and holder D, one may see that there is a dc supply from source terminal 61 through a pull-up resistor 82 and a conductor 81 that leads to stationary contact 46 in holder D. Thus, voltage is supplied to contact 52 in card E and appears on a conductor 83 in the leash cord. Conductor 83 is connected to a junction point 84. From that point, the voltage or command signal is applied to a line 85 to the other input 80 of AND gate 65. This fulfills the fourth condition for left movement. With both inputs 79 and 80 to AND gate 65 in a true state, its output 67 will switch to a high logic level or true state and trigger the relay driver 63 to energize relay coil L and thereby close contact 57 and cause motor 21M to rotate in the direction that will drive the carriage and the storage unit 5 on it to the left. This storage unit will continue being driven left until its safety sweep bar 29 strikes an obstruction in closing aisle 1 or until the actuating plunger 36 of left limit switch LLS36 strikes stop 86 on stationary unit or wall 4 to open the limit switch, whichever occurs first. If the limit switch LLS36 or series safety switches 31 open due to an obstruction in aisle 1 or if a spanning leash is removed, or if the move command signal is interrupted by withdrawal of card E, the output of left-movement control AND gate 65 will switch to an untrue or low logic level state and cause the motor 21M to stop. When the master unit 5 begins moving left the slave unit will begin to move right as will be discussed a few paragraphs later after some noteworthy comments are made.

Any time that a safety sweep bar 29 is actuated by an obstructing object or a person in a closing aisle, the safety sweep switches 31 will open and remove the input signal to time delay circuit 75 in which case there can be no output to the input 76 of AND gate 77 so the drive motor 21M will stop. If the left safety sweep bar is actuated and then cleared, for example, the time delay will not be reset for a predetermined period of time such as at least 12 seconds, by way of example, in the illustrated embodiment so no movement of the storage unit 5 to the left can occur during that time delay interval. An advantage of this is that if, for example, a person's foot is touched by safety bar 29 or any of the safety bars, storage unit drive is interrupted for at least 12 seconds even though by reflex the foot has been drawn away from the safety sweep bar. This gives the person an adequately long time to walk out of the occupied aisle. If all other conditions remain true, of course, the mobile master unit 5 will start to move again provided all four of the conditions for movement are fulfilled. An advantage of the time delay is that the person will not have to suffer the consternation of having the carriage and safety sweep bar driven at him or her again an instant after retracting the foot, for example, to some distance from the safety sweep bar. Of course, if the person did not get out of the aisle and maintained contact with the safety sweep bar, carriage movement would be inhibited for as long as the safety sweep bar is actuated. That is, the time delay interval would not expire under any circumstances until the safety sweep bar 29 is cleared of the obstruction by an object or person.

As sometimes happens, there may be a small object lying on the floor over which the storage units translate which might jam against a safety sweep bar and let very little space between storage units for reaching in and getting the obstructing article out of the small space. An obstructing object might, for example, be a small scrap paper box that might have been inadvertently dropped when the aisle was open or it might be an object that fell from one of the shelves without being noticed. As will be discussed in more detail later, in any case where an obstructing object must be removed, the system provides for driving the unit facing the obstructing object and all other mobile units in sequence in a direction away from the obstructed aisle to make the object accessible for removal. A significant feature of the invention is that a mobile unit is always prohibited from being driven in a direction toward an obstruction that actuates a sweep bar but even if the sweep bar is actuated, its effect can be negated so that it is always possible to drive a unit away from an obstruction.

The master storage unit 5 has two safety sweep bars such as 29 and 30 on the same unit. Slave units have one safety sweep bar such as bar 35 in FIG. 4.

Consideration will now be given to the events that cause slave unit 6 and any additional slave units to begin moving to the right in sequence while master unit 5 begins moving to the left in connection with opening aisle 2. Movement of a trailing slave unit would start as soon as a leading unit moved away from it far enough for the limit switch of the trailing unit to close. As indicated earlier, in FIG. 4 card E is inserted in its own holder D so voltage appears at junction point 84 in the master control unit in FIG. 4A. This command signal voltage is then also applied to one input 86 of an OR gate 87 which simply passes the signal or, stated in another way, its output 88 goes to a high logic level or true state. The right command signal on output 88 is then transmitted by way of a two-conductor cord 89 to junction point 90 in the slave unit 6 control circuitry in FIG. 4B. By way of line 97, this move right command signal is applied to one input 98 of a right-movement control AND gate 96. Thus, one of the four conditions required for slave unit 6 to move to the right is fulfilled. The right safety sweep circuit including its contacts 113 in the slave unit must also be true and right limit RLS112 on the slave unit must be true. Moreover, aisle 3 must be spanned by a leash since it is not the aisle that is selected to be opened. Presently, all of the conditions for right movement of slave unit 6 are met. Card H is inserted in holder I on stationary storage unit 7 so that a leash 40 does span aisle 3 which is to close. The signal for indicating that the leash is in the spanned or so-called safety position results from a signal derived from the output terminal 94 of dc power supply 93 in the slave unit which is comparable to power supply 60 in the master unit. In the slave unit, with card H in holder I, the voltage from source 94 is applied through a pull-up resistor 101, card H contact 52, holder contact 46, a jumper 102, holder contact 47, card H contact 51, and out on line 103 to a junction point 104 in the slave control unit. A line 105 connects junction point 104 to an input 106 of an AND gate 107. The other input 108 of AND gate 107 is connected to the output of an inverter 109 whose low input side is connected to a line 110 that is in a low logical level state now. Thus, the output of inverter 109 is in a high level or true state. Since true signals are applied to inputs 106 and 108, the output of AND gate 107 becomes true and this signal is applied to input 99 of the right movement control AND gate 96. Now the condition that the leash on an aisle that is to be closed just span that aisle has been met or, in other words, this leash is in the so-called safe position.

The move right command signal from the master control unit OR gate output 88 appearing at junction point 90 in the slave unit control is also applied to one input of an OR gate 91 which propagates the command signal to its output 92 to provide a move right command signal to any mobile slave unit, not shown, which in some installations might be interposed between slave unit 6 and stationary shelving or wall 7. The command signals from unit to unit are sent by way of two-conductor cables such as those marked 89 which drapes between successive mobile units but not to stationary units. Incidentally, it is interesting to note that these cables 89 constitute the only fixed electrical connecting link between mobile units. Thus, to a large extent, the controls for master and all slave storage units are quite independent of each other and constitute entities in themselves. Hence, it should be evident that a storage unit installation might comprise only one master unit interposed between two stationary walls where the master unit, as is characteristic of it, carries two safety sweep bars and two limit switches whereas the slave units have only one safety bar and one limit switch.

For the slave unit 6 to move right, the right safety sweep and limit switches must be true. Thus, the contacts of right limit switch RLS112 connect to a control voltage source 94 and to an input 117 of an AND gate 116. The other input 115 to AND gate 116 is the output from a time delay circuit 114 which is similar to time delay circuits 73 and 205 in the master unit and functions in the same way. That is, in slave unit 6, if its right safety sweep bar 35 is not actuated by an obstruction, there will be a true input to time delay circuit 114 by reason of the right safety sweep switches 113 being connected in series and to the control voltage source 94 through a pull-up resistor 122. When the safety sweep switches 113 are closed or true, the output of time delay circuit 114 to input 115 of AND gate 116 will be true and, as previously explained, the output 118 of AND gate 116 will go to a high logical level or true and this signal will appear at junction point 119 from which it is fed by way of a line 120 to input 100 of the right movement AND gate 96. Now all four conditions for right movement of slave unit 6 are fulfilled and the output 95 of AND gate 96 goes to a high or true logical level to provide a signal to the appropriate relay driver that results in the slave carriage drive motor 21S rotating in a direction to drive slave unit 6 to the right. As previously explained, the slave unit 6 will continue moving to the right until the right safety sweep bar 35 encounters an obstruction, if any, in aisle 3 or until the right limit switch RLS112 is actuated by its plunger 38 striking a stop 117 on the stationary shelving unit 7, which ever is first to occur. When the limit switches on the slave unit and master unit become actuated or opened, aisle 2 will be open to its full width. At this time, there is, of course, no leash spanning aisle 2 so a person can walk into the aisle without impediment. As a dual safety feature, an unauthorized person would have to remove card E from holder D and place card E in holder F to create one enabling condition for having either the slave or master unit move toward the open aisle 2 and the person would also have to put one of the other leash cards in its own holder in order to specify the other aisle which is to be opened. It is unlikely that anyone would do this without noticing that open aisle 2 is occupied by a person. Even so, no danger would be created since safety sweep bar 30 and the like would always be actuated to stop movement.

In FIG. 4 where the master storage unit 5 is being driven to the left and the slave storage unit 6 is being driven to the right, there are certain components in their controls which are not active but are active under other circumstances. In the control circuitry for master unit 5 in FIG. 4A, for example, the output of right-movement control AND gate 66 can never go high to cause right movement when left movement has been ordained because there is no right movement command signal to an input of AND gate 66 as a result of card B not being inserted in card holder C. Other components which are involved only in right movement of master unit 5 are AND gate 200, inverter 201, AND gate 202, diode 203, AND gate 204, time delay circuit 205, right limit switch RLS206, safety sweep bar 30 and safety sweep switches 33.

Figure 2:
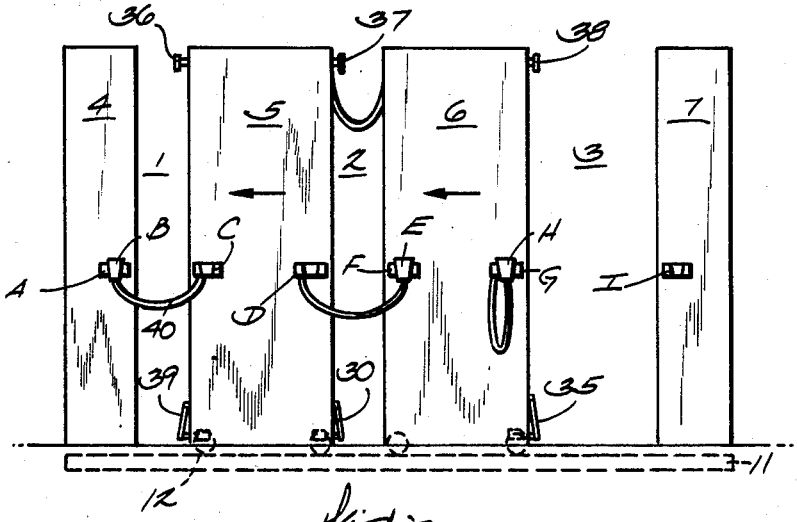
FIG. 2 shows the same system as the preceding figure and is used for illustrating what happens when it is desired to open aisle 3 in which case mobile units 6 and 5 move to the left.

Components in the slave storage unit control circuitry which are not involved in right movement of the slave unit are AND gate 209, inverter 210, diode 211, AND gate 212 and diode 213. The components mentioned in this and the preceding paragraph are involved or active along with other components in the case where, as in FIG. 2, master storage unit 5 and slave storage unit 6 are both driven to the left for opening aisle 3 which is between the one slave unit 6 and stationary unit 7. Opening of aisle 3 as identified in FIG. 2 will now be described in reference to the diagram in FIG. 5 composed of parts 5A and 5B which is identical to FIG. 4 insofar as the circuit components that are present are concerned but the leash cards are placed in different holders in FIG. 5 to effect sequential left movement of storage units 5 and 6 so aisles 1 and 2 will close and aisle 3 will open. In FIG. 2 assume that initially storage unit 6 is far to the right against stationary shelving unit 7 and master storage unit 5 is abutting slave storage unit 6 and aisle 1 is wide open when the shelves are encountered by the user in contemplation of opening aisle 3 by taking the action that will cause master unit 5 and slave unit 6 to begin to move sequentially and to the left until their limit switches or safety switches are actuated, whichever occurs first. Thus, in FIG. 2 aisle 1 which is to be closed is spanned by a leash cord 40 and card B is plugged into or inserted in holder A. Card E is inserted in holder F and is spanned by a leash cord 40 which is mechanically attached to holder D. Aisle 3 which is to be opened is unspanned by a leash cord and card H is inserted in its own holder G providing the command signal for causing storage unit 5 and 6 to move left to their left limits. The leashes are arranged in FIG. 5 similarily to the way they are arranged in FIG. 2.

In FIG. 5 as was explained in connection with FIG. 4 where the master unit was moved to the left to open an aisle either immediately or remotely from the aisle next to it to the right, card B is in holder A and a voltage signal is supplied from terminal 61 through leash conductor 70 and the card B and holder contacts 51,47, jumper 71, contacts 46 and 52 and out to line 72. Line 72 connects to left limit switch LLS36 which provides one true signal to an input 73 of AND gate 77 because limit switch LLS36 is closed. There is also a signal provided from control voltage source terminal 61 through left safety sweep switches 31 to provide an input to time delay circuit 75 whose output 76 constituting another input to AND gate 77 will be in a high logical or true state as a result of safety sweep switches 31 being closed. Again, the fact that there is a signal on line 72 indicates that leash 40 spans aisle 1 which is going to close since aisle 3 is intended to be opened. Since both inputs to AND gate 77 are true, the output 78 of AND gate 77 goes to a high logical or true state indicative of the left safety sweep switches 31 being closed or true and the left limit switch LLS36 being closed or true and of the leash spanning a closing aisle. The composite of the three true signals is transmitted from output 78 to input 79 of AND gate 65. Master unit 5 will not move to the left, however, until the other input 80 to AND gate 65 becomes true or receives a move left command signal by means of a properly placed leash. Moreover, the controls in slave unit 6 and any other slave units to the right of master unit 5 must be conditioned for preparing these units to move left before any unit can move to the left. The manner in which the move left true command signal is developed for applying it to the input 80 of left movement directing AND gate 65 in the master unit and to input 214 of AND gate 209 in the slave unit which is the counterpart of AND gate 65 in the master unit will now be described.

Figure 5B:
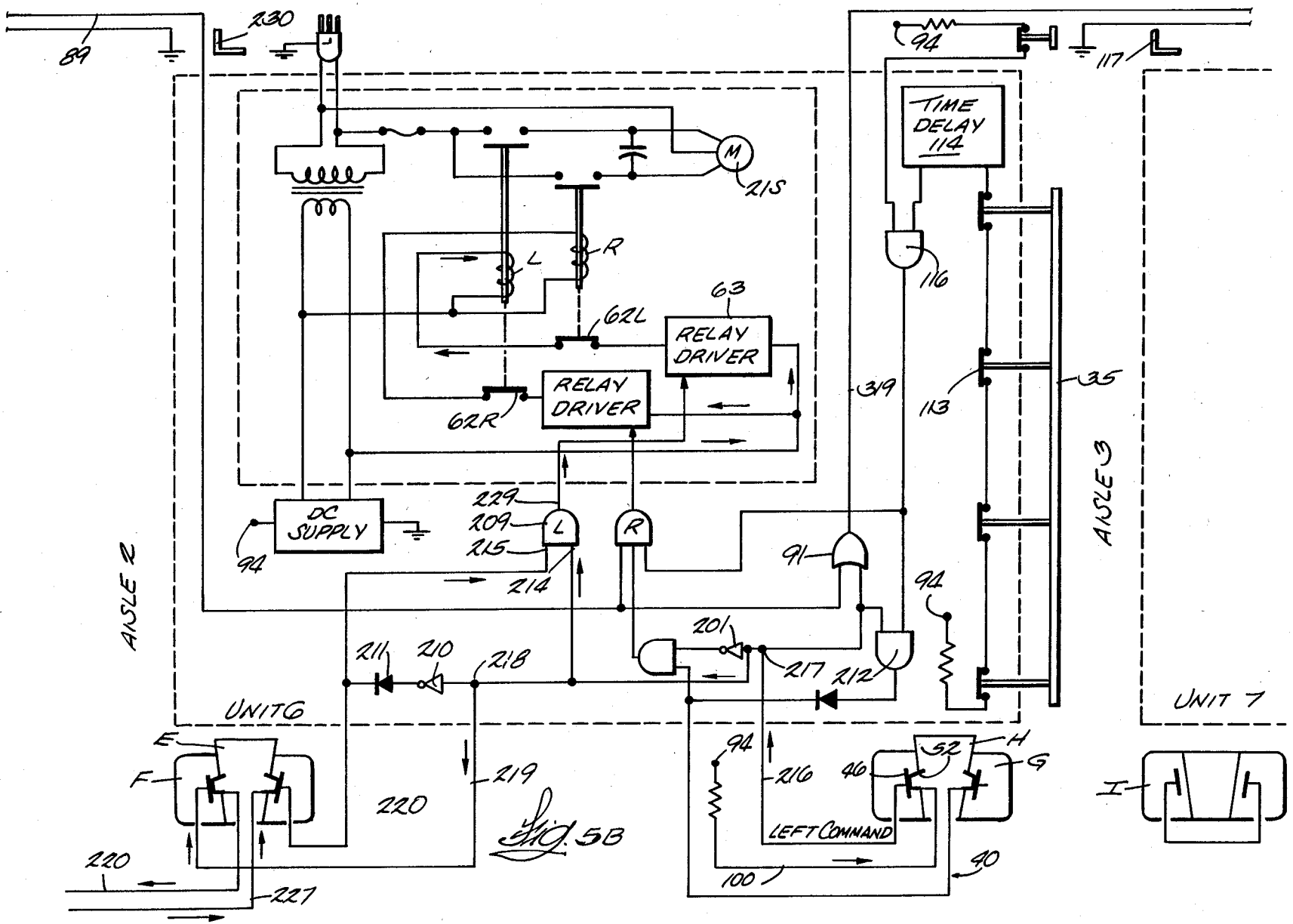

The move left command becomes true when card H is inserted in its own holder G on the side of slave unit 6 next to aisle 4 which is to be opened as in FIG. 5B. In other words, the leash cord does not span aisle 3 which is intended to be opened. With card H in holder G on the slave unit, power is supplied from control voltage source terminal 94 and line 100 which is in series with contacts 52 and 46 on the card and holder, respectively, so that the high logic level or true move left command signal comes out on line 216 and arrives at a junction point 217 in the slave unit control in FIG. 5B. This makes another junction point 218 to the left true. The signal from point 218 is sent along line 219 through the left pair of contacts in holder F and card E and this signal exits from the card E in FIG. 5B by way of a line 220 in leash cord 40 for arrival at junction point 84 in the master control unit in FIG. 5A. From junction point 84 the signal is sent by way of line 85 to input 80 of the left movement control AND gate 65. Now inputs 79 and 80 of AND gate 65 would be true and its output would go to a high logical level or true. Upon this event, carriage motor 21M would start to rotate in a direction that would cause the master unit to start moving to the left. The move left command for the slave unit 6 is not, however, effective at this moment to let slave unit 6 begin to move. Note, however, that since card H is inserted in its own holder G that a move left command signal flowing out of junction point 217 is actually applied to the move left command input 214 of left movement control AND gate 209 in the slave unit 6. Up until this time there has been no true signal applied to input 215 of left movement directing AND gage 209. The composite true signal on input 215 is inhibited until the master begins to move for at least one reason which is that the right limit switch RLS206 on the master would have been actuated or set untrue or open while the master unit to the left was still abutting the slave unit on its right. When the master begins to move left, its limit switch RLS206 closes and makes input 221 of AND gate 204 true. Since the master unit 5 in FIG. 5A has begun to move left away from the slave unit 6, it is certain that the right safety sweep bar 30 on the master unit 5 will go to an unactuated condition in which case the series connected safety sweep switches 33 will all be closed. Because of this circuit being supplied with voltage from control voltage source terminal 61, time delay 205 will have a true input so its output will be true and this will make the other input 222 of AND gate 204 true. When the output 223 of AND gate 222 goes to a high logical level or true state, it is indicative of the right safety switches 33 and the right limit switch RLS206 being true or closed. Now that the output 223 of AND gate 204 goes to a true state, this signal is transmitted by way of a line 224 to one input 225 of AND gate 202. The other input 226 of AND gate 202 is already true because it is being supplied with true move left command signal from function point 84 in the master control. Thus, the output 231 of AND gate 202 goes high and sends a signal through diode 203 for being conducted through conductor 227 of the leash cord for making a loop through holder F and card E. This composite signal is output on a line 228 which transmits the composite signal to the other input 215 of left movement control AND gate 209 in the slave unit. Its output 229 then goes high and provides a signal to the appropriate relay driver for slave motor 21S to turn in a direction that moves slave unit 6 to the left. This movement will start immediately after the plunger of right limit switch RLS206 on master unit 5 is cleared during the first moment of movement by the master unit to the left. Movement of the master to the left will continue until its left limit switch LLS36 opens as a result of its plunger striking stop 86 on stationary unit 4. Left movement of the slave unit 6 will closely follow the master and will continue until the right limit switch RLS206 on the master unit is actuated by the stop 230 on slave unit abutting it.

It is interesting to observe that the right safety sweep bar 30 and right limit switch RLS206 on the master ordinarily perform the functions of stopping the master unit if it were moved to abutting the slave to its right or if the right safety sweep bar encountered an obstruction if the master were moving to the right. In the left storage unit shift operation just described, however, one may see that the right safety sweep bar 30 and right limit switch RLS206 on the master, particularly the right safety sweep, would stop movement of the slave unit to the left if the sweep bar were actuated by any obstructing object between the slave unit and master unit. Thus. sweep bar 30 acts as a right and left movement sweep bar for the master unit and its adjacent slave unit.

Figure 3:
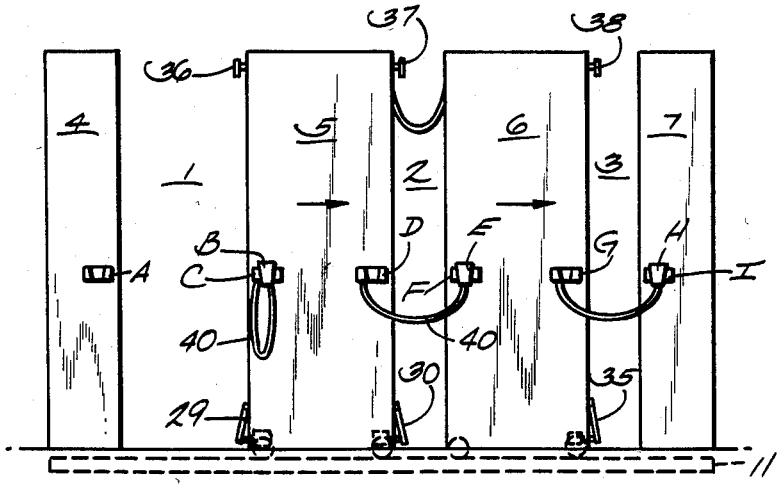
FIG. 3 is similar to the preceding figures but is used to explain what happens when opening of aisle 1 is desired in which case units 5 and 6 must move to the right.

The third movement mode for the storage units will now be described in reference to FIG. 3 and FIG. 6, parts 6A and 6B. FIG. 3 shows the master storage unit 5 and slave storage unit 6 in motion to the right. Assume at the outset that right slave unit 6 was against master unit 5 in FIG. 3 and that the latter was against stationary storage unit 4 such that aisle 1 was closed and opening it is desired. This calls for a movement that closes aisles 2 and 3. Thus, in FIGURE 3, leash card B is placed in its own holder on master unit 5 adjacent the aisle 1 which it is desired to open. In order to provide a move right move command signal, card B must be in holder C such that the leash cord is not spanned across aisle 1. The other leashes must span across aisles that are going to be closed by opening of aisle 1. Thus, card E is inserted in holder F so its leash cord spans aisle 2. Likewise, card H is inserted in holder F so its leash cord spans aisle 2. Likewise, card H is inserted in holder I so its leash cord spans aisle 3.

The leash cords and cards in the FIG. 6 circuit diagram are positioned as they are in FIG. 3.

In part A FIG. 6, card B is in the activation or move command position in its own holder C on master unit 5 adjacent aisle 1 which is to be opened by a right shift of master and slave units 5 and 6. Card B provides a signal from control voltage source 61 through line 70 and through the card and holder assembly and out on line 300. Thus, junction point 301 is at a high logical or true state. Junction point 301 connects to an input 302 of the move right control AND gate 66 and one condition for master unit 5 to move to the right is fulfilled in that there is a valid command signal to move to the right by reason of card B being in holder C and aisle 1 is unspanned by a leash. The right safety switches 33 and right limit switch RLS206 must also be true or closed to fulfill two more required conditions before there can be movement of the master unit to the right. If the right limit switch RLS206 on master unit 5 in FIG. 6A is being actuated by switch stop 230 on slave unit 6 being in abutting relation to the master unit initially, right limit switch RLS206 will be open until the slave unit 6 moves to the right by a small amount and then the master unit could start to move right if all other conditions for movement are fulfilled. Assume that this is not the case but that aisle 2 was open initially so limit switch RLS206 is closed. The signal provided through limit switch RLS206 in master unit 5 from source 61 will then be applied as a true signal to input 221 of AND gate 204. Assume further that the right safety sweep bar 30 is not actuated so its switches 33 are closed. Consequently, for reasons explained before, there will be a true signal out of time delay 205 and input 222 of AND gate 204 will be true as will its output 223. This true signal is transmitted by way of line 224 to junction point 305 from which it is further transmitted to input 304 of right move command AND gate 66. Now two additional conditions for right movement of the master have been met and they are that the right safety sweep switches 33 are true or closed and the right limit switch RLS206 is true. All that is now required for the master to be conditioned for the movement is to provide to the other input 303 of right movement controlling AND gate 66 a signal indicative of the fact that the leash on the right side of the master unit 6 is spanning across aisle 2 which may be open or closed at this time.

The right leash true signal power is actually derived from the next adjacent slave storage unit in FIG. 6B. The leashes for aisles 2 and 3 must span these aisles because they are aisles that are to be closed and not opened. Thus, leash card E is in holder F so its leash 40 spans aisle 2. Leash card H is in stationary shelving holder I. Its leash spans aisle 3. The signal indicating that the leashes are true or in spanning condition originates at control voltage source 94 and by way of leash conductor 100 enters holder I and card H where it loops through the jumper and comes out on line 103, the signal flow directions being indicated by the arrows adjacent the conductors. This leash true indicative signal is transmitted to input 106 of AND gate 107. The other input 108 of AND gate 107 is already in a high or true logical state, since the inverter 109 has its input connected to a line that is presently in an untrue or low logical state. Since both inputs 106 and 108 of AND gate 107 are true, its output 111 is true. This true signal is transmitted by way of a line 306 to an input 99 of move right command AND gate 96 so one of the conditions, namely that the leash having conductors 100 and 103 aisle 3 which is to close, for the slave unit 6 to move right is fulfilled. Now junction point 218 in the slave control in FIG. 6B is also at a low logical level. Consequently the output of adjacent inverter 210 is in a high or true state. This signal is coupled through diode 211 and is fed down line 228 to the card E and holder F combination. Here the leash true current flows through contacts 47 and 51 and exits on conductor 306 in the leash cord. This conductor transmits the leash true signal which is established by having card E in holder F to input 307 of AND gate 200 in FIG. 6A, thus making one input to this AND gate true. The other input 308 of gate 200 is true already since the input of inverter 201 in FIG. 6A is connected to junction point 84 which is presently at a low logical signal level. The result is that the output 309 of AND gate 200 goes to a true state and provides a true signal to input 303 of the move right controlling AND gate 66. The output 305 of AND gate 66 thus switches to a true state and provides a signal to the proper relay driver for making carriage motor 21M rotate in a direction that will drive the master storage unit to the right as soon as the right limit switch RLS206 closes if it is not closed.

As indicated earlier, as a result of card B being in holder C a move right activation or command signal was delivered over line 300 to junction point 301 in the master control in FIG. 6A. This signal is fed to input 315 of AND gate 87 and goes through the AND gate to its output 88 which allows this true signal to be transmitted by way of the move right command line 89 to a junction point 316 in the slave 6 control unit. Since junction point 316 connects by way of line 317 to input 98 of move right control AND gate 96, this input becomes true and is indicative of the slave unit 6 having received the move right command signal that basically resulted from having card B inserted in holder C adjacent opening aisle 1. The move right command signal is transmitted also from junction point 316 to an input 318 of OR gate 91 which passes this command signal to a line 319 that would transmit it to the next slave unit, if there were one, so it would be conditioned for moving to the right in the manner of the slave unit 6 which is now being discussed.

At this juncture, the final conditions for conditioning the slave unit 6 to begin moving to the right to close aisle 3 have not been discussed. The required conditions are that the right safety sweep switches 113 and the right limit switch RLS112 must be closed or true. Since there is assumed to be no obstruction in aisle 3, these switches are true in which case there is a true or high logical signal on the output of AND gate 116 which is fed from the time delay unit 114 and right limit switch RLS112. The high or true signal on the output 118 of AND gate 116 is conducted to junction point 119 and then to input 100 of right control AND gate 96. So, presently, AND gate 96 has inputs corresponding to the move right command signal having been received, and to the right leash being spanned across the next aisle, and through the composite conditions that the right safety switches and right limit switch are closed or true. Consequently, the output 95 of right movement control AND gate 96 goes high or true and the signal is delivered to the relay driver which effects rotation of carriage drive motor 21S in a direction that will drive the slave unit 6 carriage to the right. If the right limit switch RLS206 of the master unit were opened at the time the slave unit began to move right, this would clear the limit switch RLS206 so it would close and master unit 5 would start to drive to the right soon after the slave unit began to move. The slave unit would run until its right limit switch RLS112 was actuated by striking stop 117 on the stationary shelving unit 7. The master unit 5 which started moving to the right a moment after the slave unit 6 started to move would continue to move until the plunger of its right limit switch RLS206 was actuated by contacting stop 117 on the slave unit at which time the master unit would have caught up with the slave unit and the left aisle 1 would be wide open. Thus, in the movement mode discussed in reference to FIGS. 3 and 6 it will be evident that the mobile units start to move in the same direction in sequence and stop moving in reverse sequence. It should be evident that this is true of the other FIGS. 1 and 2 modes also.

The responsibility of the left and right safety sweep bars 29 and 30 on the master unit and the one bar such as bar 35 on each of the slave units to stop movement of the carriages moving toward any obstruction was described in sufficient detail when the mode of movement relating to FIG. 1 was being described. All of the safety sweep bars perform the same function which is to stop movement when there is an object or a person in an aisle constituting an obstruction and to provide a time delay for a person to leave the aisle without fear of further carriage movement. In respect to FIG. 6 situation where both carriages or storage units are moving to the right, if an obstruction is encountered by safety sweep bar 35 on the slave unit 6, for example, and aisle 3 must be opened to clear it, all that is necessary is to reset the leash cards as they were in the FIG. 2 movement mode in which case slave unit 6 would be driven away from the obstruction in aisle 3. If, on the other hand, the right safety sweep bar 30 on master unit 5 had encountered the obstruction so as to require opening of aisle 2 to clear it, the leash cards may be set for the aisle 3 opening mode as they are in FIG. 1. In this case slave storage unit 6 would be driven to the right and master storage unit 5 would be driven to the left to widen aisle 2 for clearing the obstruction. Prior art leash control systems do not obtain any coaction between the safety sweep bars and leashes since they do not even use safety sweep bars in combination with leashes but rely entirely on leashes to do all of the controlling. Hence, the risk of injuring a person in an aisle is present. Moreover, if there is an inanimate object obstructing storage unit movement, the moving unit in the prior art leash control system will have a tendency to drive and possibly crush the object or overload the carriage motor so that its thermal protection such as a fuse might open its circuit.

Although a preferred embodiment of the invention has been described in detail, such description is intended to be illustrative rather than limiting, for the invention may be variously embodied and is to be limited only by interpretation of the claims which follow.

I claim:

1. Storage apparatus comprising at least one movable master storage unit having a front side and left and right sides and stationary members to the left and right of said movable unit and spaced from each other by a substantial distance such that said movable unit can be moved toward the stationary member at the right to open a first aisle to the left of said unit and can be moved toward the stationary member at the left to open a second aisle to the right of said movable unit, reversible motor means on said movable unit operative to drive said unit selectively to the left or right in response to occurrence of corresponding movement direction control signals, respectively, and means for guiding the movement of said movable unit between said stationary members, safety sweep bar means on the left and right sides of said movable unit and corresponding left and right sweep switch means respectively operable from a closed state to an open state in response to said left or right sweep bar means encountering an obstruction during left or right movement of said unit, left and right limit switch means responding to said unit having moved a predetermined distance toward the stationary member at the left and the right, respectively by switching from a closed state to an open state, a plurality of holders each having electrical contacts therein, one holder located on each of the stationary members and one holder located at the left and another holder at the right on the front side of said master movable unit, a plurality of leash cords comprising at least two electrical conductors and plug means having electrical contacts therein for contacting the contacts in the holders and one end of said conductors in said leash cords connected to said contacts in a plug means, respectively, the opposite ends of said leash cord being secured to said movable unit, said plug means being insertable in and withdrawable from said holders, said leash cords being long enough to span across aisles when said aisles are closed and when said aisles are open, said plug means when inserted in the holder on a selected one of a stationary member and the movable unit such that the leash cord on said plug means spans across an aisle that must be closed by the movement of said master movable unit in order to open another aisle being defined as a leash-untrue state and a move command signal true state, left movement and right movement controlling gate circuit means on said master unit each having an output for said movement direction control signals, respectively, and each having a plurality of inputs for receiving signals indicative of whether the sweep switch means, and limit switch means on said unit adjacent an aisle that is to be closed are in a closed state and whether the leash at said aisle that is to be closed in said leash-true state and whether there is a move command signal indicative of the leash cord at the aisle that is to be opened being in said leash-true state, said gate circuit means receiving all of said signals representative of switch closed and true states and responding by providing a said movement direction control signal that causes the unit to be driven away from the aisle that is not spanned by a leash cord, encountering of an obstruction by the one sweep bar means on one side of said movable unit while said movable unit is moving in one direction toward one of said stationary members to close an aisle at which said leash cord is in a true-state causing the sweep switch means operated by said one sweep bar means to switch to said open state to thereby stop movement of the movable unit in said one direction while allowing the limit switch means on the other side of said movable unit and the sweep switch means operated by the sweep bar means on the other side of said movable unit adjacent the aisle that is opening to be maintained in a closed state such that by transfering the plug means on the leash cord that was in a true-state at the obstructed aisle into its said own holder so the leash cord no longer is in a true-state at the obstructed aisle thereby causing an untrue state for preventing movement of said unit in the one direction and by concurrently transferring from its own holder the plug means on the leash cord that was in its said own holder to permit opening of the aisle to the holder on the other adjacent stationary member for the cord to span said aisle and be in a leash-true state so said unit will move in a direction away from said obstruction, time delay means having input and output means and operative to provide a true signal at its output means when there is a true signal at its input means and to provide an untrue signal at its output means for a predetermined time interval in response to the true signal to its input means being interrupted, means coupling the output means of said delay means to an input of said movement controlling gate circuit means, said sweep switch means being connected in a series circuit between an electric power source and said input means of the time delay means, encountering an obstruction by said sweep bar means on a moving storage unit causing said sweep switch means to switch to said open state to thereby cause an untrue signal at the input and output means of said time delay means and at said input to the movement controlling gate circuit means so that movement of the storage unit is stopped for at least said predetermined time interval and as long as said sweep stitch means are said open state.

2. The apparatus according to claim 1 wherein:

said means for coupling the output of said time delay means to an input of said movement controlling gate circuit means includes AND gate means having a plurality of inputs and an output coupled to said input of the movement controlling gate circuit means, one input of the AND gate means being connected to said output of the time delay means, said limit switch means being in a series circuit between an electric power source and another input to said AND gate means for providing a true signal to said other input when said limit switch means are in a closed state, opening of said limit switch means causing an untrue signal to appear on the output of said AND gate and on the said input to the movement controlling gate circuit means to thereby stop movement of the storage unit.

3. The apparatus according to claim 2 wherein the conductors in a leash that spans an aisle that is to be closed and the contacts in the leash plug and a holder are in said series circuit with said limit switch means.

4. The apparatus according to claim 1 including at least one slave movable storage unit on said guide means having a front side and left and right side, said unit being interposed between said master unit and one of said stationary members, reversible motor means on said slave unit operative to drive said slave unit selectively to the left and right in response to occurrence of corresponding movement direction control signals, respectively, said slave unit having safety sweep bar means on a side remote from the sweep bar means on the side of the master unit across an aisle from said slave unit, and sweep switch means operable from a closed state to an open state in response to said sweep bar means on said remote side of the slave unit from said master unit encountering an obstruction when moving in a direction away from said master movable storage unit, at least one limit switch means on said slave unit responding to said slave unit having moved to the limit of its travel up to another slave unit or up to one of said stationary members by switching from a closed state to an open state, two holders on the front side of said slave mobile storage unit, one located on the left region and the other on the right region of said front side, each holder having electrical contacts therein, a leash cord comprising at least two electrical conductors, plug means having electric contacts therein for contacting contacts in the holders and corresponding ends of said conductors being connected to said contacts, the opposite ends of said leash cords being secured to said slave unit in said left and right regions respective of said front side adjacent said holders in said regions, respectively, said plug means being insertable in its adjacent holder such that said leash cord to which said plug means is attached does not extend across an aisle and being alternately insertable in a holder on a selected one of the next adjacent slave unit and said stationary members such that the leash cord to which the plug is attached does extend, said leash cord being defined as being in an untrue state when its plug means is in the holder to which the cord is secured and being in a true state when spanning the next adjacent aisle and its plug means is inserted in the next adjacent holder, left movement and right movement controlling gate circuit means on said slave unit each having an output for said movement direction control signals and one circuit having a plurality of inputs for receiving signals including a command signal and signals indicative of whether said sweep switch means on said slave movable unit adjacent the aisle that is to be closed when said slave unit is to move in a direction to the right away from said master unit in order to open an aisle to the left of said slave unit or said master unit and whether said leash cord on said slave unit is in a true state wherein it spans the aisle to be closed, the other of said gate means having a plurality of inputs for receiving signals including a command signal and signals indicative of whether said leash cords between said slave unit and master unit and master unit and stationary member are in a true state wherein they span the aisles which are to be closed and the leash cord on said slave unit is in the holder adjacent to where said cord is secured such that said cord does not span the aisle to its right which is to open and said other gate means receiving a signal indicative of whether the limit switch means and sweep means and sweep switch means are closed on the master unit adjacent the slave unit when said slave unit is to move to the left in the direction of said master unit when the aisle to be opened is to the right of the said slave unit, said command signals being provided by the plug means that is in the holder adjacent to where the leash cord is secured, the gate circuit means that receives input signals indicative of the safety sweep switches and the limit switches being closed and the leashes being in a leash-true state together with a command signal responding by producing direction controllling signals that cause the motors to drive the units in a direction away from the aisle at which the leash plug means is in the holder adjacent to which the leash to which the plug is attached is secured, encountering of an obstruction by a sweep bar means on a movable slave unit when moving in a direction to close an aisle spanned by a leash cordwhile opening the aisle that is not spanned by a leash cord causing the sweep switch operated by said sweep bar means encountering the obstruction to switch to an open state to thereby stop movement of said slave units such that by putting the plug means on the leash cord spanning the aisle that was closing and is obstructed into the holder adjacent to where the cord on the plug means is secured so the leash cord does not span said aisle and concurrently transferring the plug means on the leash cord that was in the holder adjacent to where the cord of said plug means is secured into the holder on the adjacent unit for causing said master and slave units to back away from said obstruction, an OR gate in the control circuitry on said master unit and having a plurality of inputs and an output, inserting the plug means of the leash cord into said holder at the left said of said master storage unit so said leash does not span the adjacent aisle to the left which it to be opened causing an electrical connection to be made between an electric power source and said OR gate input to thereby provide a signal at its output constituting a command signal for the adjacent slave unit to move to the right so the master storage unit can move to the right when its limit switch closes, and a conductor connected between the output of said OR gate on said master storage unit and an input to the gate circuit means for controlling movement of said slave storage unit to the right.

5. A storage unit system including at least one storage unit that is movable toward and away from another unit, reversible electric motor means on each movable storage unit for driving said unit in two directions, motor controller means responding to input of a first control signal by causing said motor means to drive said movable unit in one direction and to input of a second control signal by causing said motor means to drive said unit in another direction, safety sweep bar means on at least one side of said movable unit and sweep switch means operable from a closed state to an open state as a result of said sweep bar means encountering an obstruction during movement of said movable unit in one direction, circuit means for transmitting said first control signal to said motor controller means, said sweep switch means being connected in said circuit means and operative to inhibit said first control signal when said sweep switch means is open, and time delay means including time delay switch means in said circuit, said time delay means responding to opening of said sweep switch means by opening said time delay switch means to further inhibit said first signal when said sweep means is opened, said time delay means responding to reclosure of said sweep switch means by initiating measurement of a predetermined time interval and responding to expiration of said interval by closing said time delay switch means to terminate inhibition of said first control signal.

* * * * *